United States Patent [19]

Grayek

[11] Patent Number: 4,575,369

[45] Date of Patent: Mar. 11, 1986

[54] METHOD OF FORMING A KNOCKDOWN HANDBAG AND MAT

[76] Inventor: Rose M. Grayek, 35J Leslie Rd., Bridgeport, Conn. 06606

[21] Appl. No.: 710,508

[22] Filed: Mar. 11, 1985

Related U.S. Application Data

[62] Division of Ser. No. 546,278, Oct. 28, 1983, Pat. No. 4,516,668.

[51] Int. Cl.[4] ..... B31B 31/26; B31B 31/60

[52] U.S. Cl. ..... 493/226; 493/225; 493/267; 493/931; 493/937

[58] Field of Search ..... 493/226, 243, 267, 268, 493/383, 409, 931, 937, 225, 310

[56] References Cited

U.S. PATENT DOCUMENTS

| | | | |
|---|---|---|---|
| D. 220,414 | 4/1971 | Marshall | D87/5 |
| 2,659,404 | 11/1953 | Kelsey | 383/4 |
| 3,013,597 | 12/1961 | Moran | 493/225 |
| 3,052,895 | 9/1962 | Lo Vico | 5/417 |
| 3,550,663 | 12/1970 | Johnston | 150/103 |
| 3,571,812 | 3/1971 | Speevak | 493/409 |
| 3,830,348 | 8/1974 | Ohyama | 190/107 |
| 4,101,994 | 7/1978 | Hoyt | 5/344 |
| 4,154,323 | 5/1979 | Sneider | 190/2 |

*Primary Examiner*—Francis S. Husar
*Assistant Examiner*—William E. Terrell
*Attorney, Agent, or Firm*—Arthur T. Fattibene

[57] ABSTRACT

A method of making a combination knockdown handbag and mat from a blank of readily foldable sheet material by reversely folding a portion of the sheet onto a portion of the blank and securing the reversely folded portion onto the adjacent portion of the blank to define one or more open end pockets. In the unfolded position thus formed, the blank defines a mat with one or more pockets formed at one end. To convert the mat into a handbag, the extended portion of the blank is folded in an accordian fashion one or more times to the size and shape of the reversely folded portion. The blank thus folded is reversely folded about a central portion thereof, and the pocket formed is turned inside out so that the accordian folded extended portions are disposed within the pocket turned inside out to define the handbag. A handle may be secured to the pocket to facilitate the carrying of the handbag in the folded position of the blank.

4 Claims, 13 Drawing Figures

FIG. 1
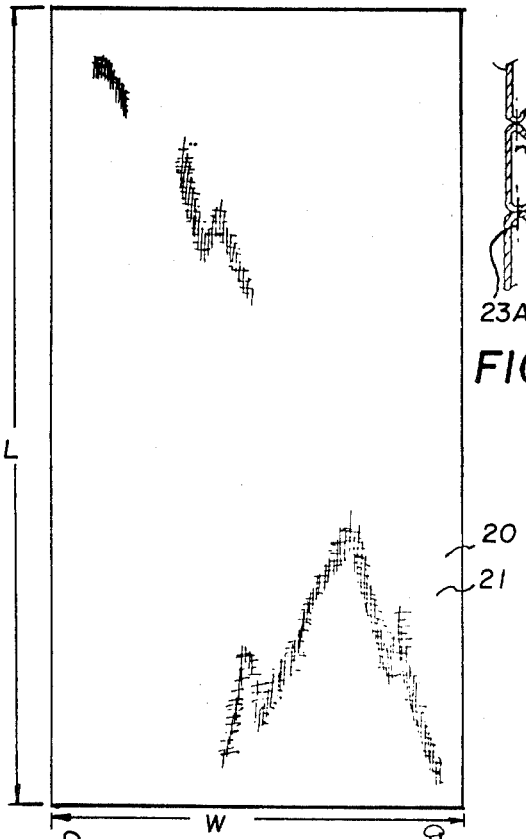
FIG. 2
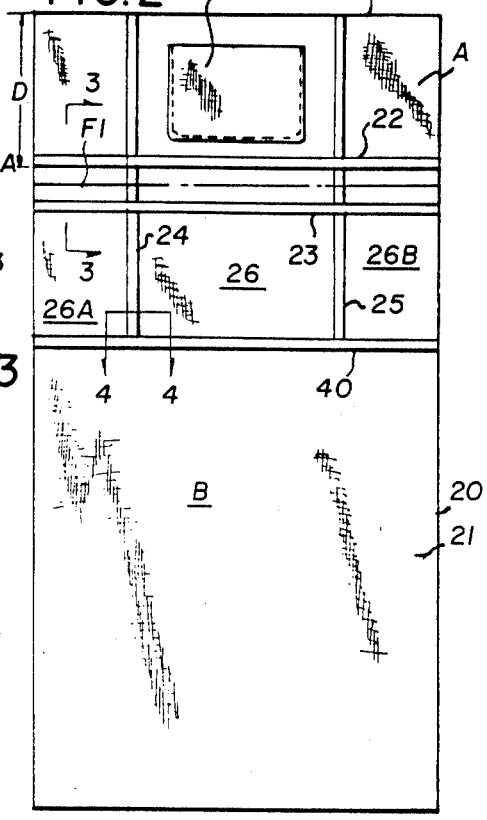
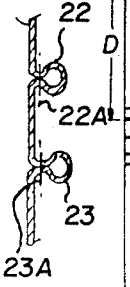
FIG. 3
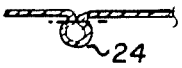
FIG. 4
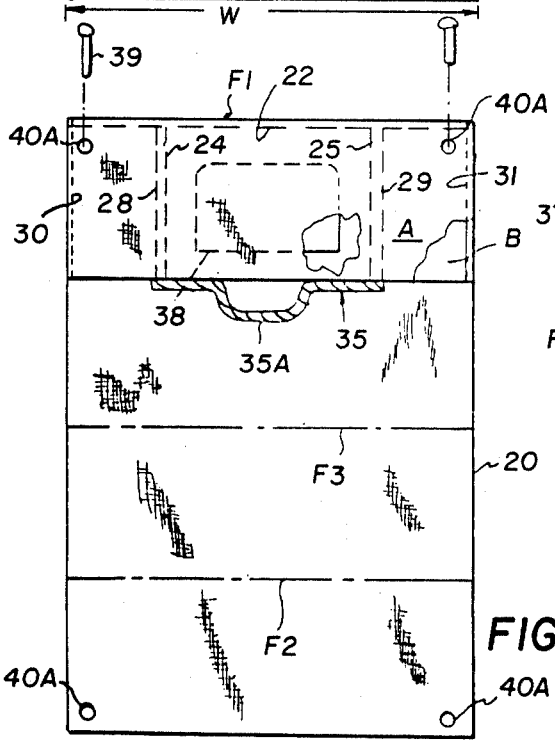
FIG. 5
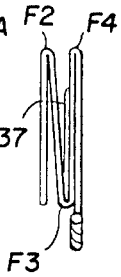
FIG. 7
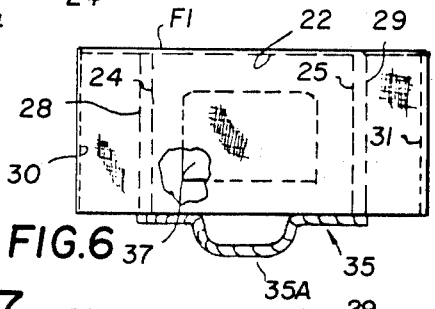
FIG. 6
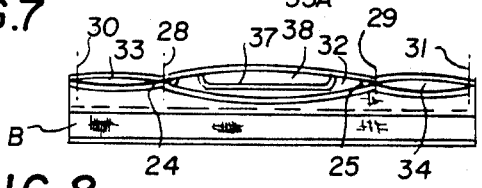
FIG. 8
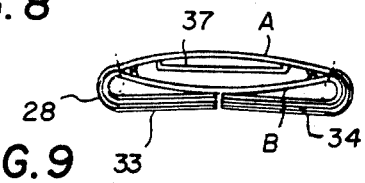
FIG. 9

METHOD OF FORMING A KNOCKDOWN HANDBAG AND MAT

RELATED APPLICATIONS

This is a divisional application of my co-pending application Ser. No. 06/546,278 filed Oct. 28, 1983 for Knock-Down Combination Handbag and Mat and Method of Making Same, now U.S. Pat. No. 4,516,668 granted on May 14, 1985.

This invention is directed to a combination knock-down handbag and mat comprising a blank 20 of foldable sheet material, such as a towel or blanket 21 which in the assembled position can be folded so as to define a portable handbag as seen in FIG. 11 and which in the unfolded position can be utilized as a mat or towel upon which one can lie as seen in FIG. 5.

PRIOR ART AND PURPOSE OF INVENTION

Heretofore, various efforts have been made to provide an article which can be utilized in one form as a mat or towel, and which can be used in another form as an article having a different utility. Some of the prior known efforts directed to various articles having dual utility are disclosed in U.S. Pat. Nos. 124,007; 1,256,783; 1,696,362; 1,741,156; 1,930,942; 2,038,335; 2,044,717; 2,045,784; 2,264,471; 2,659,404 and French Pat. No. 693,192. However, such previous known articles generally require an additional device, as for example a preformed container or receptacle, in which the mat or towel can be placed after folding and hence are not really directed to a unitary article having dual utility as two distinct and separate devices which is readily made of a single or unitary piece of material in which one can be carried in the other.

In contrast to the prior known devices, the invention hereafter described is directed to a unitary foldable blank of sheet material which is formed and constructed so that it can be actually used as a handbag for storing other articles in the folded position of the blank; and as a mat in the unfolded position of the blank. Thus, it is one at the same time a towel or an extended mat when unfolded and as a container or handbag for the mat in the folded position, and in which other articles may be carried.

The subject matter of the invention has particular application as an accoutrement for bathing and it is particularly useful for use on beaches, where it may be used in the unfolded position as a mat or towel on which to lie, and alternately in a folded position as a handbag in which the mat and other articles or items of apparel and comfort may be carried that are usually utilized at a beach or resort area.

OBJECTS

It is an object of this invention to provide a mat or towel or sheet of material which can be readily folded and formed into a unique handbag having one or more pockets in which other articles may be stored in a folded position of the blank, and which in the unfolded position of the blank can be utilized as a mat or towel to lie upon.

In another object to provide a combination handbag and towel or mat, formed of a unitary blank or sheet material which is specifically formed and secured so as to define one or more internal pockets in the folded position thereof.

Another object of the invention is to provide an article of manufacture which is relatively simple and inexpensive to manufacture, and which is positive in operation.

A BRIEF SUMMARY OF THE INVENTION

The foregoing objects and other features and advantages of this invention are obtained by a blank of flexible sheet material having a predetermined length and width which can be readily folded to define a handbag in the folded position, and which in the unfolded position of the blank defines a mat upon which one can lie, as at a beach. The combination handbag and mat is formed by first forming a pair of spaced apart transversely extending seams formed in the plane of the blank or sheet material at a point intermediate the length thereof. The transverse seams so formed are spaced a distance from one end or edge of the blank, an amount substantially equal to the depth of the desired assembled bag. A second pair of spaced apart seams are formed in the plane of the blank so as to extend longitudinally thereof from the previously defined edge or end of the blank a distance equal to substantially twice that the depth of the assembled handbag. Accordingly, the end portion of the blank adjacent said edge is folded along a transverse fold line disposed between first transverse pair of seams so as to be reversely folded onto an adjacent portion of the blank of material. The reversely folded portion is then secured to the adjacent portion of the blank of material by any suitable means, such as e.g. stitching or fusing, to define one or more open end pockets. A cord or handle is attached to the open end of the pocket so formed. The extended portion of the blanket or mat is then reversely folded to the size and shape of the reverse folded portion. The opposed end portions of the folded blank are then reversely folded relative to the central portion thereof to the size of the handbag to be formed. With the blank of material thus secured and folded, the bag is formed by grasping the inside end corners of the central pocket and turning the pocket inside out. In so doing, the transverse seams define the bottom and side edges of the folded handbag. To form the mat, the handbag is unfolded in the reverse manner to its expanded position.

FEATURES

A feature of this invention resides in the provision that the combination handbag and mat can be formed from a single unitary blank of foldable sheet material.

Another feature of this invention resides in the provision that the handbag may be provided with one or more internal pockets for receiving and storing various articles.

Another feature of this invention resides in the provision that a patch pocket may be secured to one side of the assembled handbag to form another pocket for carrying various articles.

Another feature of this invention resides in providing stakes for securing mat in the unfolded position to the ground.

Other features and advantages will be more readily apparent when considered in view of the drawing and detailed description in which:

FIG. 1 is a plan view of an expanded blank of foldable sheet material from which the combination handbag and mat is formed.

FIG. 2 is a plan view of the sheet material of FIG. 1 in which a pair of transversely and longitudinally extending seams have been formed in accordance with this invention.

FIG. 3 is a detail sectional view taken on line 3—3 on FIG. 2.

FIG. 4 is a section view taken on line 4—4 on FIG. 2.

FIG. 5 is a plan view of the unitary sheet of material as shown in FIGS. 1 and 2 illustrated in its assembled and unfolded position to define the mat upon which one can lie.

FIG. 6 is a view of the mat of FIG. 3 illustrated in the intermediate folded position to form the handbag.

FIG. 7 is an end view of FIG. 6 to illustrate the intermediate folds.

FIG. 8 is a front end view of the folded mat position of FIG. 6.

FIG. 9 is a front view illustrating another intermediate folded position to illustrate the relative position of the folds immediately prior to the final step in forming the handbag.

DETAILED DESCRIPTION

Figure 11:
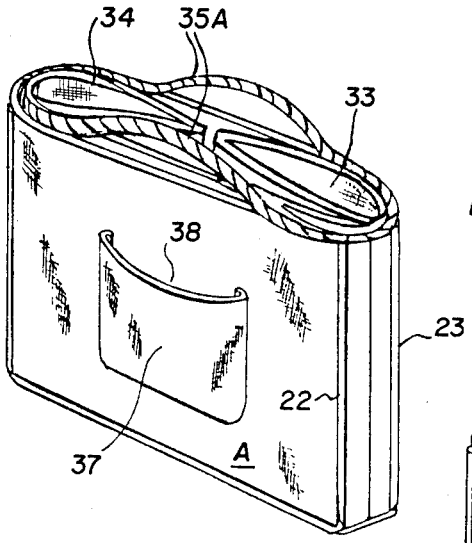
FIG. 11 is a perspective view of the assembled handbag.

Referring to the drawings, and more particularly to FIG. 1, there is illustrated a single piece of foldable sheet material, e.g. a towel or terrycloth type material or blanket material 20 which is cut in a rectangular shape 21 having a predetermined width "W" and a predetermined length "L". It will be understood that the length and width may assume any suitable dimension and that the foldable material may comprise any suitable type of material such as fabric or plastic. With the sheet material 21 disposed in its expanded position, as shown in FIG. 1, a transversely extending bead-line seam 22 is formed in the plane of the blank 20 at a distance D measured in one edge or end 21A of the sheet 21. The distance "D" defines the depth of the handbag in the folded position as it will become hereafter more apparent. A second seam 23 is formed parallel and spaced from seam 22 to define a pair of transversely extending beadlike seams intermediate the length of sheet 21.

It will be noted that the seams 22, 23, extending transversely of the sheet 21, are formed by a pinch fold and securing said folds to define the seams 22 and 23. As shown in FIG. 3, the bead seams 22, 23 are formed by a pinch type pleat with the folds of the pleat secured by a sewn seam 22A, 23A. If the sheet 21 is formed of plastic, the seams may be formed by fusion, heat sealing or sonic welding.

A second pair of seams 24, 25 are similarly formed in the plane of the sheet 21 so as to extend longitudinally thereof from the edge 21A of the sheet 21. While the spacing of the longitudinally extending seam 24, 25 is not critical, the arrangement is such that the pair of seams 24, 25 divides the sheet into a central part 26 and a pair of outer parts 26A, 26B; the outer parts 26A, 26B being generally equal in width. If desired, a third transverse seam 40 may be formed across the blank perpendicular to the ends of the longitudinal seams 24 and 25. Seams 24, 25 and 40 are a pinch fold beaded seam similar to seams 22, 23.

As best seen in FIG. 5, the end portion A of the sheet 21 is reversely folded about a transverse fold line $F_1$ which extends between a pair of transverse beaded seams 22, 23, so that in the folded position the beaded seams 22, 23 are disposed between the folded portion A and the underlying portion B of the sheet 21, and extends parallel thereto. Seam 40 in the folded position of the blank defines a beaded seam along one edge of the pocket formed by the reverse folding of portion A into portion B of the sheet. As best seen in FIG. 5, reverse portion A of the sheet or blank 21 is secured to the adjacent portion B of the sheet by suitable securing means, as for example a threaded stitch. In the illustrated embodiment, the securing means comprises a first pair of seams 28, 29 spaced just outwardly of the inturned longitudinally extending beaded seam 24, 25. A second pair of seams 30, 31 extend along the outer longitudinal edge portion of the blank or sheet 21 so as to secure the reversely folded portion A to the underlying portion B of the blank or sheet. Thus, in the form of the invention shown in FIG. 5, the securing means 28, 29, 30 and 31 define a central open ended pocket 32 and a pair of open end pockets 33, 34 disposed to either side of the central pocket 32.

In accordance with this invention, a handle means 35 in the form of a cord 35A is connected to the open end of the central pocket 32, e.g. by sewing. If desired, a patch 37 may be secured to portion A in the area of the central pocket portion, as indicated in FIGS. 2 and 8, to define an extra external pocket 38 when the sheet 21 is folded in the handbag position as noted in FIG. 11.

When the sheet 21, formed as described, is unfolded, as shown in FIG. 5, it is in a position to be utilized as a blanket or mat upon which one may lie. If desired, the article as disclosed in FIG. 5 may be positively secured to the ground by providing holding stakes 39 which may be inserted through the corner portions of the sheet 21 formed as described. Grommets as indicated at 40A may be used to define the stake holes for securing the mat in the form shown in FIG. 5.

To convert the mat, as shown in FIG. 5, to a handbag position, as indicated in FIG. 11, the extended portion B of the mat is reversely folded about transverse fold lines $F_2$, $F_3$ and $F_4$ in an accordian type series of folds so as to conform the extended portion B of the mat to the size and shape defined by the reversely folded end portion A, as best seen in FIGS. 7 and 8. With the extended portion B thus folded relative to the reversely folded portion A, as shown in FIGS. 7 and 8, the opposed outer pocket portions are reversely folded relative to the central pocket portion 32, as best seen in FIG. 9. To form the handbag after the blank or mat has been folded, as indicated in FIG. 9, one need only to place one's hands into the central pocket portion, i.e. between the reversed folds of portions A and B and grasp the opposed corner portions X and Y of the central pocket, and turn the pocket 32 inside out so that the outer pocket 33 and 34 and the accordian folded portion are now inside the central defined pocket 32, and the handle means 35 circumscribe the open end of the central pocket 32 (see FIG. 11). In the inside out position as described, the transverse beaded seams 22, 23 define the external bottom and sides of the folded handbag, as best seen in FIG. 11; and the outer pockets are disposed within the central pocket 32 to define internal compartments for receiving various articles which one may wish to carry or store in the formed handbag. Also, the patch pocket 38 is disposed to the outer side in the folded handbag position of the sheet.

The entire assembly after assuming the shape of the handbag, as herein described, is carried by a cord handle 35A which is formed by sewing either a continuous loop of cord about the open end of the central pocket portion, or by sewing a length of cord to each opposed edge of the central pocket. It will be noted that the cord loop is affixed to the main body portion of the article by suitable stitching to the free edge of the central pocket 32; with the central portion of the cord being unattached to define a handle. The construction is such that when the unit is turned inside out to form the handbag, both sides of the bag are supported by the handles 35, there being no stitching formed in the intermediate portion of the cord, thus providing a convenient handle grip 35A as can be readily noted in FIG. 11. It will thus be apparent that the manner of transforming the beach mat, formed as shown in FIG. 5, into the handbag or recepticle as shown in FIG. 11, is extremely simple and positive in operation.

It will be understood that further embellishments may be formed, e.g. the opposed edges of the blank or sheet may be hemmed to provide a finished edge to the periphery of the sheet prior to forming the same as hereinbefore described. Also, the grommets may be omitted if desired. If desired, the manner and location of the seams can be varied without departing from the inventive concept described.

Figure 12:
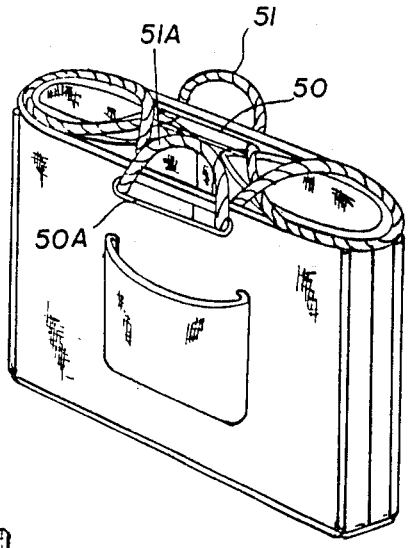
FIG. 12 is a perspective view of a modified detail of construction.
Figure 10:
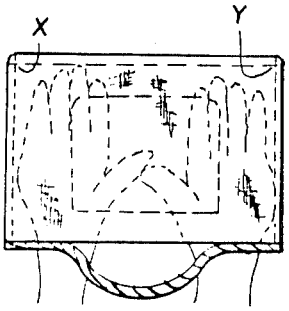
FIG. 10 illustrates a top plan view of FIG. 9 showing the placement of one's hands for turning the pocket inside out to form the handbag.
Figure 13:
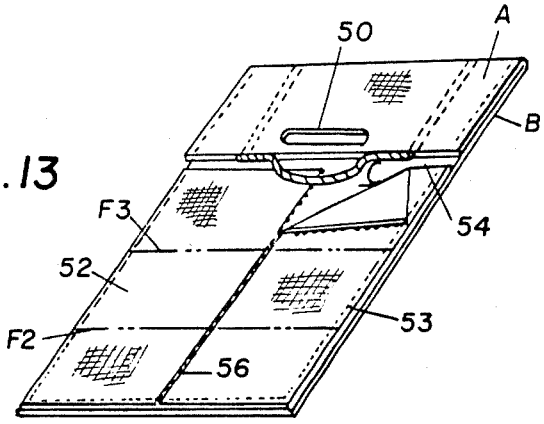
FIG. 13 is a modified embodiment illustrating the invention applied to a sleeping bag type mat.

FIG. 13 illustrates a modified construction of the invention described whereby a means is provided to lock or secure the open end of the handbag in the assembled position. This is attained by providing the reversely folded end portion A of the blank with a slit 50 which is illustrated in the form of the invention shown in FIG. 13. The portion of the blank B subjacent to the folded portion A is also provided with a similar opposed slit 50A. As shown, the respective slits 50 and 50A are formed adjacent the upper end of the handbag side defining portions. It will be understood that slits 50 and 50A may be formed in the form of the invention disclosed in FIGS. 1 to 11 in the same manner as shown in FIGS. 12 and 13.

As best seen in FIG. 13, the open end of the assembled handbag can be secured or drawn to a substantially closed position by extending the handle loop or portion 51 opposite slit 50 through the slit 50. Similarly, the handle grip or loop 51A opposite slit 50A is criss-cross through slit 50A so that when the handbag is carried the hand grips 51, 51A being criss-crossed through its respective slit function to effect a closing or a drawing of the open portion of the bag together, and thus tends to close or seal the open end of the assembled handbag to secure the contents therein. FIG. 12 illustrates the manner in which the handle grips 51, 51A are criss-crossed to effect a closure for the assembled handbag.

FIG. 13 illustrates another modified construction. The extended portion of the blank is indicated at C is provided with a cover sheet 52. It will be understood that the cover sheet 52 may be a separate sheet or may be an extension of portion C which is reversely folded thereto. In the illustrated embodiment, the cover sheet 52 is a separate sheet which is suitably secured by any suitable means, e.g. sewing about a peripheral seam 53, so as to define an open end 54. In the illustrated embodiment, the cover sheet may be longitudinally split as at 55 to define access to the pocket formed. The slit is provided with a suitable slide fastener 56 whereby the cover sheet can be readily parted and reparted. Thus, in this form of the invention, the mat portion can be formed into a sleeping bag type mat by the addition of the cover sheet 52 as described.

It will be understood that the construction of FIG. 13 can be readily folded to define a handbag assembly in the manner hereinbefore described with respect to FIGS. 1 to 11.

When the blank of FIGS. 5 and 13 is used in its mat or sleeping bag position as shown, the center pocket portion defined by the reversely folded portions A and B may be filled with clothing or the like to form a pillow for added comfort.

While the invention has been described with respect to a specific embodiment, variations and modifications may be made without departing from the spirit or scope of the invention.

What is claimed is:

1. A method for forming a combination handbag and mat from a blank of foldable material of a predetermined width and length, comprising the steps of reversely folding one end portion of said blank onto said blank so as to be disposed contiguous to a portion of said blank equal to the depth of said folded one end portion, and leaving a remainder portion;

securing said reversely folded portion to said equal portion of said blank to define a pocket having an open end;

folding the remainder portion of said blank about a transversely extending foldline to equal to the shape of the reversely folded end portion, whereby the remainder portion is disposed contiguous said reversely folded portion;

and reaching into said pocket and turning the same inside out to define the handbag.

2. A method as defined in claim 1 and including the step of securing a cord about the open end of said pocket to define a handle for said assembled handbag.

3. A method as defined in claim 1 and including the steps of forming a pair of spaced apart beaded seams in the plane of said blank extending transversely of said blank at a point intermediate the length of said blank and spaced from one end thereof substantially equal to the depth of the reverse fold, said reverse fold being folded about a transverse foldline disposed between said pair of transversely extending beaded seams, and whereby said beaded seams define both the bottom and opposed sides of the handbag.

4. The method as define in claim 1 wherein the securing of said reversely folded portion to said equal portion of said blank is attained by sewing a first pair of seams intermediate the width of said reversely folded portion to define a central pocket, and sewing a second pair of seams, each of said second pair of seams securing the adjacent edges of said folded over portions together to define an opposed end pocket.

* * * * *